United States Patent [19]

Zilch

[11] 4,408,427

[45] Oct. 11, 1983

[54] FRAMING SYSTEM FOR DEMOUNTABLE WALLS OR THE LIKE

[75] Inventor: Gregory W. Zilch, Amherst, Ohio

[73] Assignee: Donn Incorporated, Westlake, Ohio

[21] Appl. No.: 193,803

[22] Filed: Oct. 3, 1980

[51] Int. Cl.[3] ..... E04B 5/52

[52] U.S. Cl. ..... 52/481; 52/779; 52/766; 52/774; 52/508

[58] Field of Search ..... 52/481, 483, 777, 778, 52/779, 766, 508, 387, 386, 355, 354, 735

[56] References Cited

U.S. PATENT DOCUMENTS

| | | | |
|---|---|---|---|
| 1,074,242 | 9/1913 | Caldwell | 52/354 |
| 2,154,520 | 4/1939 | Mackin . | |
| 2,821,274 | 1/1958 | Olsen | 52/481 |
| 3,027,605 | 4/1962 | Nelsson . | |
| 3,217,460 | 11/1965 | Downing . | |
| 3,387,422 | 6/1968 | Wanzer | 52/387 |
| 3,533,205 | 10/1970 | Pestel | 52/481 |
| 3,640,042 | 2/1972 | Kidney | 52/779 |
| 3,708,941 | 1/1973 | Cuckson | 52/779 |
| 3,712,015 | 1/1973 | Nelson | 52/729 |
| 3,729,883 | 5/1973 | Thompson | 52/481 |
| 3,732,657 | 5/1973 | Nelson | 52/241 |
| 3,900,996 | 9/1975 | Nelson | 52/735 |
| 3,998,027 | 12/1978 | Wendt | 52/716 |
| 4,000,596 | 1/1977 | Magill | 52/481 |
| 4,112,636 | 9/1978 | Hays | 52/355 |

FOREIGN PATENT DOCUMENTS

| | | | |
|---|---|---|---|
| 596993 | 8/1959 | Italy | 52/483 |
| 612989 | 11/1960 | Italy | 52/779 |
| 571590 | 8/1945 | United Kingdom | 52/387 |

*Primary Examiner*—John E. Murtagh
*Assistant Examiner*—Henry E. Raduazo
*Attorney, Agent, or Firm*—Pearne, Gordon, Sessions, McCoy, Granger & Tilberry

[57] ABSTRACT

A framing system is disclosed for demountable walls or the like in which the frame member provides a substantially continuous backing surface to engage the back sides of panels along abutting edges thereof. Such frame member is provided with separate locking means at spaced intervals along the backup surface having locking portions which project into the edges of abutting panels to retain the panels against the backing surface. Such locking means are proportioned to fit into kerfs formed in the edges of the panel and are shaped to provide a camming action to press the back sides of the panel into snug engagement with the backup surface. The framing members may be, for example, furring strips formed of metal to secure the wall to a foreign wall, or a stud providing opposed backup surfaces for use in a wall providing panels along both sides thereof. In one form of the invention, the locking means are formed by integral tabs cut from the material of the backup surface so that the locking means do not require any additional material. In another form of the invention, the locking means are formed as separate clips which can be mounted along the backup surface at intervals. In the latter form of the invention, the framing member can be used, without such locking clips, with standard drywall construction, or may be used with locking clips for a demountable wall construction.

19 Claims, 8 Drawing Figures

FRAMING SYSTEM FOR DEMOUNTABLE WALLS OR THE LIKE

BACKGROUND OF THE INVENTION

This invention relates generally to demountable wall structures, and more particularly to a novel and improved framing system for such walls.

PRIOR ART

Metal framing for wall systems is well known. One known system, generally referred to as a conventional drywall system, employs studs or furring strips on which drywall panels are mounted by fasteners or adhesive. The joints between the panels are then taped and finished to completely conceal the joint. In addition, it is known to provide drywall studs with tabs which project over or into the edges of panels to secure the panels to the stud. Such edges are then taped and finished as disclosed in U.S. Pat. No. 3,217,460.

Another known type of system utilizes framing provided with pockets which enclose the panel edges, providing an exposed portion extending across the joint. This exposed portion, although it conceals the joint, produces an interrupted finished wall surface. An example of such system is illustrated in U.S. Pat. No. 3,712,015. Still another system employs framing members in which panels are provided with kerfs along their edges and the framing members provide flanges which fit into the kerfs to connect the panels to the framing and to maintain the panels in alignment.

In this last-mentioned system, the panels are often covered with a finished surface such as sheet vinyl laminated to the panel base material. Further, in such systems, the joints between the panels are not normally taped or plastered, but remain exposed. Such exposed joints, however, provide a neat appearance because no exposed fasteners show at the joint and the portions of the framing element which fit into the kerfs are concealed by the abutting panel edges. Such systems are often referred to as demountable wall systems because they can be rapidly installed, removed, or relocated. Examples of such systems are illustrated in U.S. Pat. Nos. 2,154,520; 3,027,605; 3,729,883; 3,732,657; 3,900,996; 3,908,328; and 3,998,027.

U.S. Pat. No. 3,900,996 describes a stud assembly having elongated clips which are removably mounted on the stud member and provide kerf-engaging flanges.

SUMMARY OF THE INVENTION

There are a number of important aspects to the present invention. In accordance with one important aspect of this invention, a demountable wall system is provided having framing elements formed with a substantially continuous backup surface along the length of the framing member engaging the inner surface of the panels along the joint therebetween and spaced kerf-engaging lock means which project into panel kerfs at intervals along the length of the joint. Such spaced lock means maintain the panels against the backup surface and in alignment with each other.

Several embodiments are illustrated. In two such embodiments, tabs are cut from the backup surface and are bent out of its plane and shaped to provide a projecting lock portion located and shaped to fit into the kerf and secure the associated panel edge to the backup surface. One such embodiment involves a furring strip which can be connected to a foreign wall and the other embodiment involves a simple, generally C-shaped stud which is used to mount two panel rows of a wall which is finished on both sides. Such embodiments are very material-efficient, since the tabs are formed from the framing member material which already exists and it is not necessary to use additional material to provide the kerf interlocking feature.

In accordance with another aspect of this invention, a more universal framing system is provided. The framing elements embodying this aspect of the invention may be used with typical drywall construction or, when desired for use in demountable kerf systems, separate clips are installed on the framing elements to engage and lock in the panel kerfs. Because a given frame element can be used in more than one type of wall system, lower production costs resulting from higher production volume can be realized. Further, inventory cost can be reduced, since it is not necessary to inventory or supply different types of framing elements for each wall system. Still further, it is practical to combine in a single wall two different wall systems. For example, drywall with taped joints can be installed on one side of a finished wall and kerf-type wall panels can be installed on the opposite side.

These and other aspects of this invention will be more fully described in the following specification.

DETAILED DESCRIPTION OF THE DRAWINGS

Figure 1:
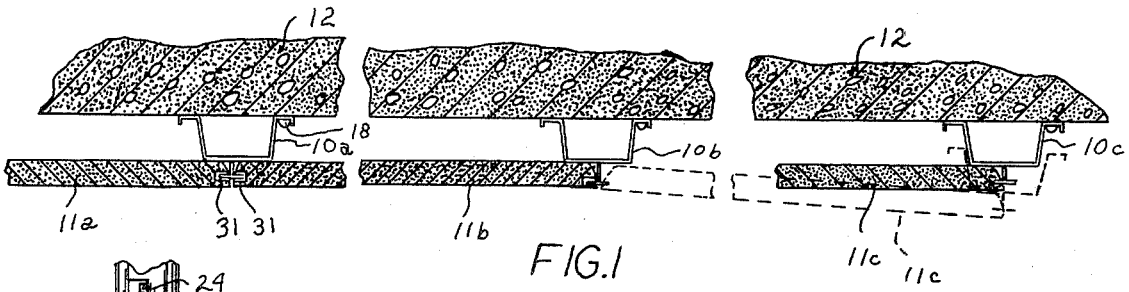
FIG. 1 is a fragmentary section of an embodiment of this invention in which a demountable wall is installed over a foreign wall, which may be, for example, cinder block or cement wall.

FIGS. 1–4 illustrate a first embodiment of this invention in which furring strips are utilized to secure panels 11*a* through 11*c* to a foreign wall 12 which may be formed, for example, of either cinder block or concrete. The furring strips 10 in the illustrated embodiment are formed of a single piece of sheet metal having a generally U-shaped form to provide a centered backup surface 13 and a pair of webs or legs 14 and 16 extending back from the edges of the backup surface 13. At the rearward end of each leg 14 and 16, the strip is provided with flanges 17 and 18, respectively, which extend in a coplanar relationship in opposite directions from the associated legs. Small upstanding flanges 19 and 21 are provided at the extremity of each of the flanges 17 and 18 to increase stiffness.

Figure 2:
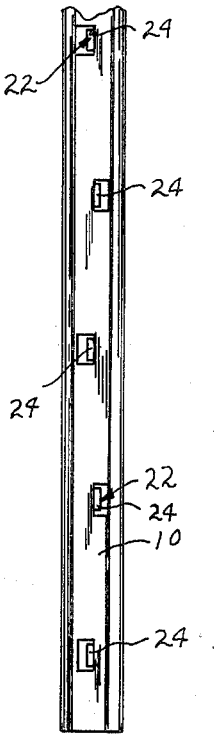
FIG. 2 is a side elevation of a furring strip employed in the wall structure of FIG. 1.
Figure 3:
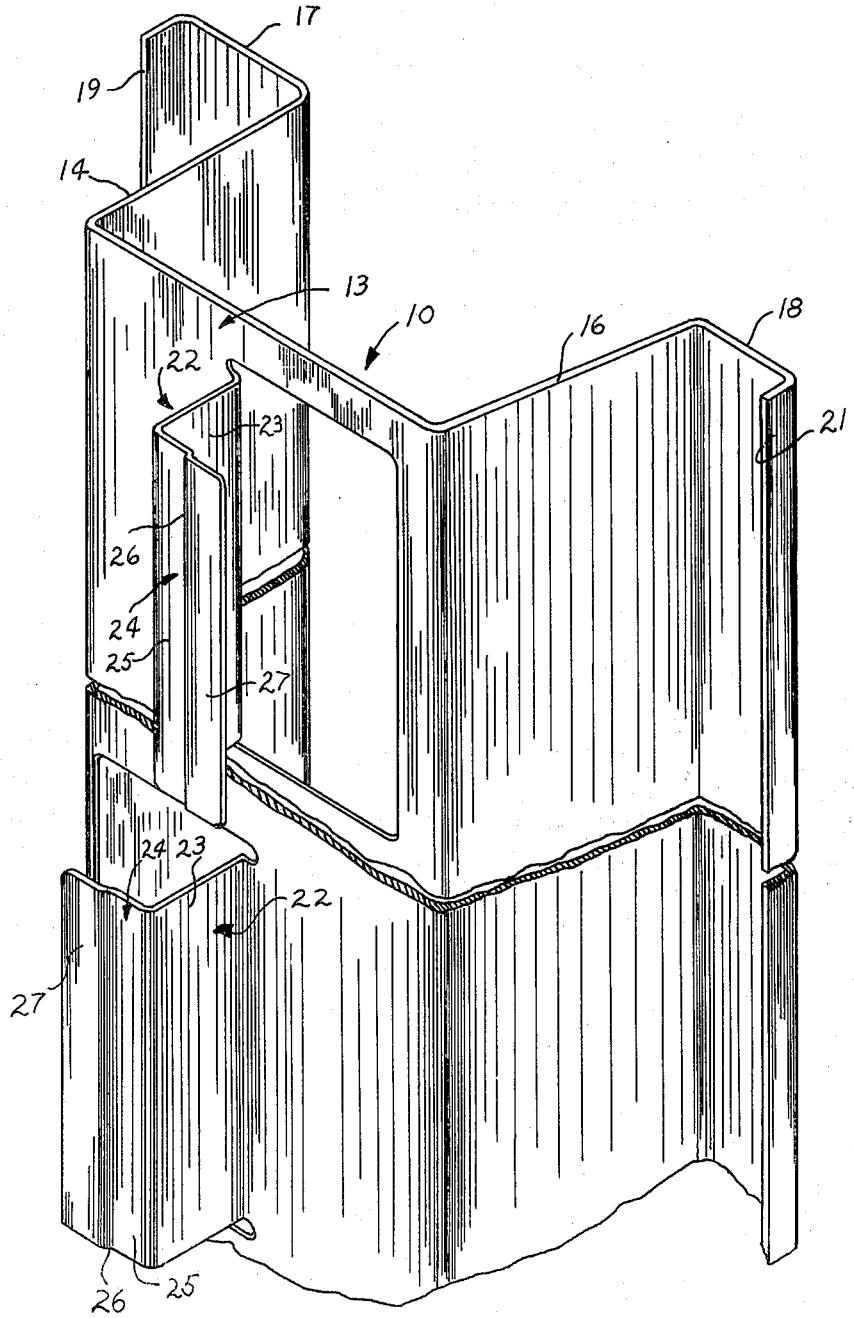
FIG. 3 is a greatly enlarged, fragmentary, perspective view of the furring strip of FIG. 2, illustrating the tab structure provided thereon.
Figure 4:
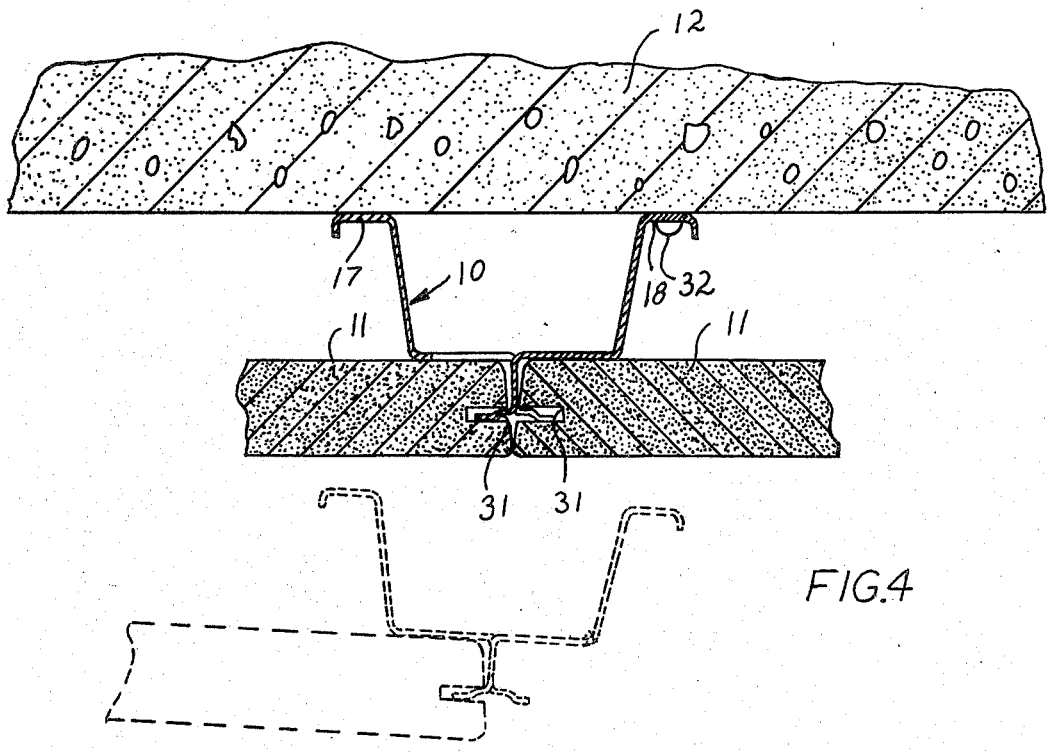
FIG. 4 is an enlarged, fragmentary section similar to FIG. 1, but illustrating the structural detail on an enlarged scale.

A plurality of spaced tabs 22 are cut from the material of the backup surface 13 and are bent out of the plane thereof to provide a lateral portion 23 extending substantially perpendicular to the backup surface 13 and a locking portion 24 extending substantially parallel to, but spaced from, the backup surface 13. Preferably, the locking portion 24 is provided with a step or shallow lateral bend 26 substantially along the center thereof which offsets the outer end section 27 from the plane of the backup surface 13 a slightly greater amount than the inner parts 25 of the locking portion 24. Alternate tabs 22 are formed with locking portions 24 which extend in opposite directions from the lateral portion 23, as best illustrated in FIGS. 2 and 3.

When a wall is installed utilizing the furring strips 10, alternate locking portions 24 fit into kerfs 31 on one panel, with the intermediate locking portions fitting into the kerfs 31 on the adjacent panel. The furring strip 10 is preferably secured to the foreign wall 12 by fasteners 32 driven through one of the flanges 17 or 18 at intervals along the length of the furring strip 10.

The installation of the wall is best illustrated in FIG. 1 and involves progressive installation of panels from one end of the wall to the other with progressive installation of the furring strips as the panels are installed. Referring to FIG. 1, a panel **11*a* is installed along its left edge (not illustrated) with a first furring strip. A second furring strip is then locked into the kerf 31 along the right edge and is secured by fasteners 18 to the wall 12. The second panel 11*b* is then interlocked with the furring strip 10*a* along the left edge and the furring strip 10*b* is installed along the right edge of the panel 11*b* and secured to the foreign wall 12. Subsequently, a panel 11*c* is interlocked in the furring strip 10*b* along its left edge and, after mounting, the furring strip 10*c* is moved from the phantom position to the full line position and the furring strip 10*c*** is then secured to the foreign wall. In this manner, the wall is progressively constructed along the foreign wall until it is completed.

Because the edges of the panels 11 are fully supported along the entire length of the furring strip 10 by their engagement with the backup surface 13, and because such backup surface 13 has a width exceeding twice the depth of the kerfs 31, each of the panels is supported against any inwardly directed loads which might be applied to the panels along the rearward surface of the panel in a zone spaced from the edge thereof beyond the kerfs. This support of the panel beyond the kerfs is important, since such portion is not weakened by the existence of the kerfs. In practice, most of the forces or loads applied to a wall are in an inward direction, so this full backup of the panel edges provides a strong structure capable of adequately withstanding the normal load applied to the wall. The lock portions 24 which extend into the kerfs at spaced locations along the panel edges provide sufficient strength to maintain the wall panels against the backup surface and it is not necessary to provide full interlocking along the entire length of the kerf, since substantial panel loads in a direction outward of the wall are not normally encountered.

The step structure of the lock portion 24 is arranged so that the outer portion 27 is spaced from the backup surface 13 a distance substantially equal to the spacing between the outer side of the kerf and the panel back side, and the inner portion 25 is spaced from the backup surface 13 by a distance no greater than the spacing between the inner side of the kerf and the panel back side. This structure serves several functions: First, it provides an edge portion spaced from the backup surface 13 which is greater than the spacing between the back side of the kerf and a back wall of the panel to facilitate the entry of the tab portion into the kerf. In addition, as the tab portion 24 is pressed into the kerf, the offset at 26 provides a camming action so that the inner section 25 thereof ensures that the panel edges are tightly pressed against the backup surface. Still further, the stepped structure provides a total effective thickness of the tab portion at least equal to the width of the kerf to prevent rattling or looseness after the wall is installed.

It is also within the broader aspects of this invention to utilize the furring strips 10 with some types of panels which do not have kerfs, such as acoustical panels or other panels in which the edge of the panel can be impaled with the tab portions 24. When the furring strips are used with such panels, the stepped structure again ensures that the panels which are impaled along their edges by the tabs will be securely and tightly held against the backup surface to eliminate any looseness, or the like. In such instance, entry of the outer portion of the tab as the tab is impaled on the panel establishes the entry position and as the tab is pressed further into the panel edge, the panel is cammed at the step or offset 26 into tight engagement with the backup surface for secure installation.

It is also within the broader aspects of this invention to form the lateral portions 23 and locking portions as separate pieces which are permanently secured to the backup surfaces, for example, by spot welding.

Figure 6:
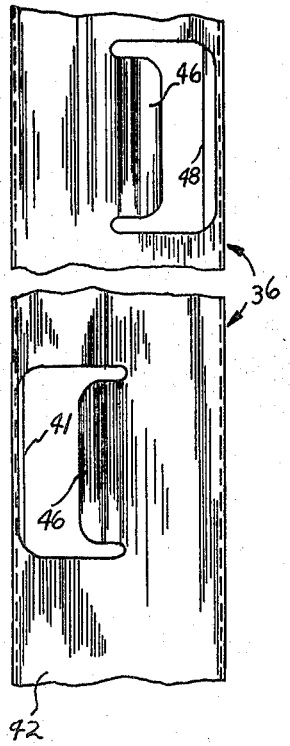
FIG. 6 is an enlarged, fragmentary side elevation of the stud illustrated in FIG. 5.
Figure 5:
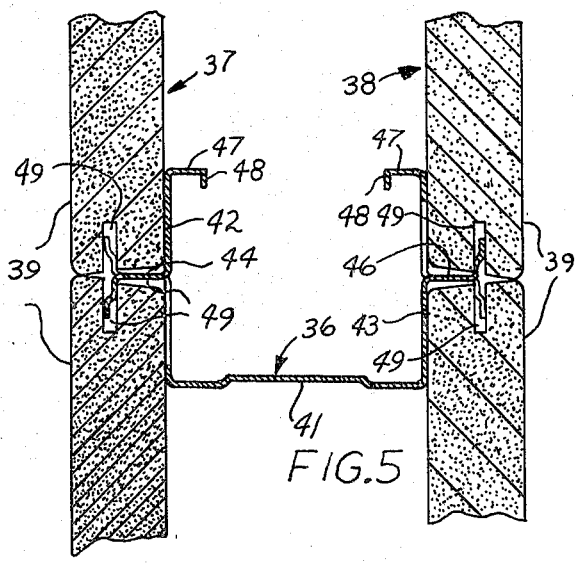
FIG. 5 is an enlarged, fragmentary section through a second embodiment in which tabs are formed on a generally C-shaped stud utilized in a wall that is finished on both sides.

FIGS. 5 and 6 illustrate a second embodiment of this invention in which the framing member is a C-shaped stud 36 of the type often used in a wall which is finished on both sides and consists of two rows 37 and 38 of edgewise abutting panels 39.

The stud 36 provides a central web 41 which extends between and connects to a pair of backup surfaces 42 and 43 at its opposite extremities. Here again, the backup surfaces are provided with mounting tabs 44 and 46 which are cut from the material of the respective backup surfaces 42 and bent to provide the same shape as the tabs 22 at intervals along the length of the stud 36. The edges of the mounting surfaces 42 and 43 are formed with lateral flanges 47 and 48 for stiffness.

Again, the studs 36 provide full backup for the panels along zones thereof spaced from the edges beyond the kerfs where the panels are not inherently weakened by the existence of the kerfs. Because the tabs along each of the backup portions extend alternately in opposite directions, alternate locking portions extend into the kerfs 49 of the panels along each side of the joints. Preferably, the tab projections are provided with step structure in the same manner as discussed above to ensure tight engagement between the backup surfaces in the inner walls of the panels and to prevent any looseness in the kerfs of the assembled wall.

In instances in which the wall is formed of wide panels which require support at locations spaced from their edges, a stud similar to the stud of FIGS. 5 and 6 may be used in which locking tabs are only provided along one backup surface. With such studs, the panels along one side are staggered from the panels along the other side, so that the joints of one panel row are located opposite about the center of the panels of the other panel row. The studs are then mounted with edge locking means engaging the panel edges of one row and the backup surface without locking means is connected with adhesive along the center of a panel of the other row.

Figure 7:
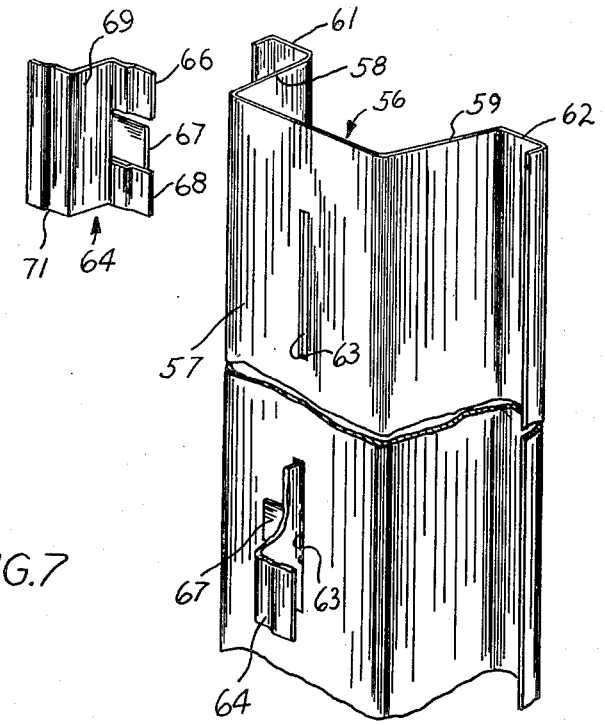
FIG. 7 is an enlarged, fragmentary, perspective view of still another embodiment in which a furring strip is adapted for use with a typical drywall structure and in which clips can be mounted on the furring strip for use in a demountable wall.

FIG. 7 illustrates still another embodiment as applied to a furring strip 56 having the same basic shape as the furring strip 10 of the first embodiment, but which can be used without mounting clips for a typical drywall installation and which can be used with separate mounting clips installed in a demountable wall-type structure. In this embodiment, a generally U-shaped form is again provided to provide a backup surface 57 and two legs 58 and 59. The legs are again provided with flanges 61 and 62, respectively, through which fasteners can be driven to attach the furring strip to a foreign wall.

Located along the center of the backup wall 57 are a plurality of axially extending, spaced slots 63 proportioned to receive separate mounting clips 64 when the furring strip 56 is to be used in a kerf system of a demountable wall. Such clips 64, as illustrated in FIG. 7, are provided with three spaced legs 66, 67 and 68, with the legs 66 and 68 bent back from the plane of the leg 67 so that they can enter the slot 63 and be laterally moved into a full mounted position, as illustrated in the lower clip 64 of FIG. 7. In such position, the two legs 66 and 68 extend through the slot 63 and along the rearward side of the backup surface 57 and the center leg 67 engages the forward side of the backup surface. The clips are again formed with a lateral portion 69 which extends substantially perpendicular to the backup surface 57 when the clips are installed and a stepped locking portion 71 extending substantially parallel to the backup surface but spaced therefrom.

With this structure, the furring strip 56 can be used in a typical drywall installation in which fasteners or adhesive are used to secure the panels to the backup surface 57, or can be used with clips inserted in the slots in a demountable system essentially as illustrated in the first embodiment.

It should be understood that the clips 64 are also usable with a stud of the type illustrated in FIG. 5, modified only to eliminate the integral tabs and to provide slots 63 along the two backup surfaces thereof. In fact, with such a stud structure, clips can be installed along one backup surface for the installation of a demountable wall panel system applied to one side of the stud and a typical drywall construction can be applied to the opposite side of the stud, providing a total wall system employing both demountable wall panels and drywall panels.

Figure 8:
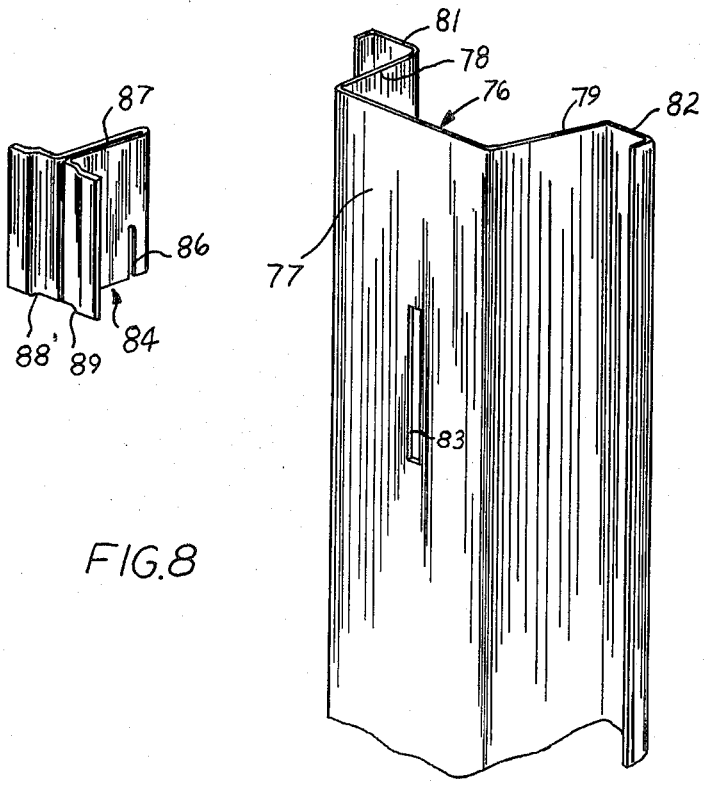
FIG. 8 is an enlarged, fragmentary, perspective view of still another form of clip mounting system for use with framing members suitable for drywall or demountable wall systems.

FIG. 8 illustrates still another embodiment in which separate clips of a different form are provided for installation on a furring strip 76 similar to the furring strip 56. Here again, the furring strip is provided with a backup wall 77, legs 78 and 79, and flanges 81 and 82. Also in this embodiment, the backup wall 77 is provided with axially extending, elongated slots 83 at intervals along its length. A clip 84 which is generally T-shaped in section is provided with a notch 86 so that the stem portion 87 of the clip 84 can be inserted into the slot 83 and then dropped down so that the notch 86 receives the portion of the backup surface 77 immediately below the notch 83. In such installed position, a clip 84 is secured to the furring strip. In this embodiment, however, the clip 84 is provided with oppositely extending stepped locking portions 88 and 89 so that a single clip extends into and locks a panel on each side of the joint. Here again, the clip of FIG. 8 can be applied with equal facility to a stud having two opposed backup surfaces, each of which is provided with slots to receive the clip.

With the embodiment of FIGS. 1–6, the stud or furring strip can be provided with locking tabs for a demountable wall system without requiring any additional material when compared to a simple furring strip or stud. With the embodiments of FIGS. 7 and 8, a separate clip permits the use of a given stud or furring strip with either a drywall type system or with a demountable system. Additionally, the amount of material required to provide spaced clips at intervals along the length of the framing member reduces the material requirement when compared to prior art systems employing continuous locking flange means along an entire length of the framing member.

Although preferred embodiments of this invention have been shown and described, it should be understood that various modifications and rearrangements of the parts may be resorted to without departing from the scope of the invention as disclosed and claimed herein.

What is claimed is:

1. A frame member for supporting the abutting edges of kerfed edge wall panels at a location spaced from an adjacent wall structure, comprising a sheet metal member providing a backup surface means engageable with the inner side of said wall panels along the joints therebetween and at least one lateral leg joined to said backup surface means and extending at a substantial angle relative thereto to support said backup surface means and maintain it substantially straight, and a plurality of panel locking means at spaced locations along the length of said backup surface means, each locking means including a separate lateral portion extending substantially perpendicular to said backup surface means and a panel edge locking portion extending substantially parallel to said backup surface means, said locking portions being adapted to extend into the kerfs of panels along abutting edges thereof to secure said panels against said backup surface means, said locking portions extending from said lateral portion along an inner part substantially along a first plane spaced from and substantially parallel to said backup surface means to an outwardly extending step and from said step along an outer part, said outer part extending along a second plane substantially parallel to said backup surface means and spaced therefrom a distance greater than said first plane, whereby assembly of a panel kerf on said locking portion causes the panel to be cammed into proper engagement with said backup surface means as it moves past said step.

2. A frame member as set forth in claim 1, wherein said locking means are integrally formed from the material of said backup surface means.

3. A frame member as set forth in claim 1, wherein said locking means are tabs cut from said backup surface means and bent to provide said lateral portion extending generally perpendicular to said backup surface means and locking portions extending substantially parallel to said backup surface but spaced therefrom a distance less than the thickness of said panels.

4. A frame member as set forth in claim 1, wherein alternate locking portions extend in opposite directions to engage kerfs along two abutting panels.

5. A frame member as set forth in claim 1, wherein said frame member is a furring strip adapted to be secured to a foreign wall.

6. A frame member as set forth in claim 5, wherein said furring strip is provided with legs extending from opposite edges of said backup surface means to space said backup surface means from a foreign wall.

7. A frame member as set forth in claim 1, wherein said framing member is a stud providing opposed and parallel backup surfaces connected by said leg.

8. A frame member as set forth in claim 7, wherein said locking means are tabs cut from said backup surfaces and bent out of the plane thereof.

9. A frame member as set forth in claim 8, wherein alternate ones of said tabs extend in opposite directions to alternately engage two abutting panels.

10. A frame member as set forth in claim 1, wherein said panel locking means are separate clips mounted on said frame member at spaced locations along its length, said clips being adapted to extend into kerfs along the edges of associated panels.

11. A frame member as set forth in claim 10, wherein said backup surface means is provided with slots at spaced locations along its length, and said clips provide a projection which extends through said slot to engage the rearward side of said backup surface means to secure said clips thereto.

12. A frame member as set forth in claim 11, wherein said clip is generally T-shaped providing opposed locking portions adapted to extend into kerfs along abutting edges of said panels, the stem of said T-shaped clips extending through one of said slots and providing a notch engaging both sides of said backup surface means adjacent to said one slot.

13. A frame member as set forth in claim 10, wherein said backup surface means are formed with spaced slots and said clips provide leg portions extendable through said slots to secure said clips to said frame member.

14. A wall structure comprising a plurality of wall panels positioned with their edges abutting along a joint, said panels providing kerfs along said edges opened to said joint, and a frame member providing a backup surface engaging the backside of said panels on both sides of said joint, said frame member providing separate, kerf-engaging means at spaced locations along its length which extend into said kerfs maintaining said panels against said surface, said kerf-engaging means including an inner part extending along a first plane substantially parallel to and spaced from said backup surface to an outwardly extending step and from said step along an outer part, said outer part extending along a second plane substantially parallel to said backup surface and spaced therefrom a distance greater than said inner part, said step operating to cam a panel against said backup surface as said kerf-engaging means is inserted into the kerf thereof.

15. A wall structure as set forth in claim 14, wherein said surface has a width exceeding twice the depth of said kerfs and said surface engages said panels along a zone spaced from the edges thereof beyond said kerfs.

16. A wall structure as set forth in claim 15, wherein said kerf-engaging means are tabs cut from said backup surface and bent to provide a lateral portion extending substantially perpendicular thereto and a locking portion substantially parallel to and spaced from said backup surface.

17. A wall structure as set forth in claim 16, wherein alternate locking portions extend in opposite directions to engage kerfs along both sides of said joint.

18. A wall structure as set forth in claim 17, wherein said framing member is a stud providing similar and opposite backup surfaces and locking portions, and said wall includes abutting panels on both sides of said stud.

19. A wall structure as set forth in claim 14, wherein said kerf-engaging means are separate clips mounted on said backup surface.

* * * * *